US005921012A

United States Patent [19]

Caivano

[11] Patent Number: 5,921,012

[45] Date of Patent: Jul. 13, 1999

[54] ILLUMINATED DISPLAY DEVICE AND MOLD USEFUL FOR THE FORMATION OF SAME

[76] Inventor: Fernando A. Caivano, Patagones 2656, (1437) Capital Federal, Argentina

[21] Appl. No.: 08/673,286

[22] Filed: Jun. 28, 1996

[30] Foreign Application Priority Data

Oct. 11, 1995 [AR] Argentina ..... 333811
Oct. 11, 1995 [AR] Argentina ..... 333812

[51] Int. Cl.[6] ..... G09F 13/00

[52] U.S. Cl. ..... 40/541; 40/552; 40/580

[58] Field of Search ..... 40/541, 552, 564, 40/580

[56] References Cited

U.S. PATENT DOCUMENTS

| | | | |
|---|---|---|---|
| 2,032,895 | 3/1936 | Slutsky . | |
| 2,114,550 | 4/1938 | Vandermeer | 40/552 |
| 2,298,940 | 10/1942 | Hayes . | |
| 2,299,331 | 10/1942 | Marinone . | |
| 3,566,525 | 3/1971 | Nassil . | |
| 3,596,869 | 8/1971 | Humphrey . | |
| 3,978,599 | 9/1976 | Berger . | |
| 4,373,283 | 2/1983 | Swartz . | |
| 4,796,170 | 1/1989 | Pederson et al. . | |
| 4,891,896 | 1/1990 | Boren . | |
| 5,237,766 | 8/1993 | Milolay . | |
| 5,330,343 | 7/1994 | Berteau . | |
| 5,345,705 | 9/1994 | Lawrence . | |

*Primary Examiner*—Cassandra H. Davis
*Attorney, Agent, or Firm*—Brown, Martin, Haller & McClain, LLP

[57] ABSTRACT

A display device is describes which forms contained formed figures such as symbols, letters or numbers, ideograms, and which can be a sign, billboard, signal, message board, etc. Each figure is formed as a narrow but high projection which stands out of the external face of a sheet which permits the passage of light originating from a source behind the sheet. Each figure is surrounded by a sector of this same sheet capable of intercepting at least part of the light, so that the figure stands out in marked high relief. Also described is a mold particularly useful for production of the formed sheet, which includes a large number of very thin rigid straight rods, abutting one another within an adjustable frame, which are movable laterally among themselves in a slidable tight relation and able to stay locked among themselves by friction against sliding during vacuum or pressure molding.

4 Claims, 5 Drawing Sheets

ILLUMINATED DISPLAY DEVICE AND MOLD USEFUL FOR THE FORMATION OF SAME

BACKGROUND OF THE INVENTION

1. Field of the Invention

The present invention relates to display devices having illuminated figures such as symbols, letters, numbers, ideograms and/or combinations of the same, intended to be used in signs, billboards, labels for signals, message boards or any similar examples and/or applications. It also relates to molds useful for the formation of the same.

2. Description of the Background

One of the current techniques for making such display devices consists of making the figure ("figurative element") as a transparent or translucent sector of a sheet, with the rest of the sheet composed of a contrasting background, and behind which a light source is installed with which it is possible to emit a degree of luminosity that permits the figure thus represented to be distinguished at a distance. Obviously, this figure will only be clearly visible in a proportionally reduced visual radius with lower degrees of luminosity, since the same is limited to the amount of light which passes through the surface encompassed by the mentioned sector of the sheet, and which generally does so as radiation oriented perpendicularly to this surface. Typical examples are shown in U.S. Pat. Nos. 2,299,331 (Marinone); 3,978,599 (Berger); 4,798,170 (Pederson et al); 4,891,896 (Boren) and 5,237,766 (Mikolay).

When there is a need to obtain a strong luminosity and, moreover, be visible in an ample radius, one resorts to the use of neon tubes to form the figure. However, this device involves a very complex realization, not only for the tube itself but also for its assembly and the electrical installation required, which carries a high degree of danger due to the high voltage with which it operates. In addition, neon tubes are very fragile, which noticeably restricts the extent of their application. Furthermore, neon tubes are highly likely to suffer deterioration caused by weather conditions when, as usually occurs, they are installed outdoors. Another disadvantage of neon tubes lies in the fact that when one tries to obtain a figure that includes various colors, the figure can only be realized through a combination of neon tubes, one for each color. To all of the above must be added the high cost of figures made with these neon tubes and the need for their regular maintenance.

Display devices such as signs which contain sheets with figures of any complexity are most readily formed by molding. However, the problems which the production of molds in general present are well known, not only for the difficulties inherent in the reproduction of the shape that one wishes to mold, but also for the high cost of the mold, which becomes particularly appreciable when one endeavors to mold a small or reduced quantity of pieces. When, for example, one endeavors to reproduce a specific piece by means of thermoforming, one is required, as is known, to make a mold appropriate for this technology, male or female depending on the circumstance, which permits a vacuum or pressure to be exerted over the sheet of plastic material heated to the necessary temperature and placed so as to cover the projection or concavity of the mold. In the case of a vacuum process, the mold must provide multiple perforations which permit the vacuum to be exerted through the mold over most of its extended area, while in the case of an air pressure process, a chamber must be formed which encompasses all the area of the mold in which the air is injected which will force the sheet to adapt to the shape of the same. In addition, in this case of a pressure process, one could choose to use a top mold which cooperates with the base mold and forces the sheet, when pressed between both, to adapt itself on both faces to the shape of one or the other. As a result, not only is it necessary to make a mold for each piece or group of like pieces which one wishes to mold, but frequently also the mold, once used, must be discarded, requiring another amount of material for the new mold that one is interested in making.

Wire or rod containing molds have been described in the prior art; see, e.g., U.S. Pat. Nos. 3,596,869 (Humphrey) and 5,330,343 (Berteau). They have, however, not been readily adjustable in both length and width to provide for firm retention of the rods or wires during molding but still facilitate sliding motion when the mold is being formed around the model.

SUMMARY OF THE INVENTION

It is therefore a principal and basic object of this invention to provide a device which through simple embodiments makes it possible to produce a display device incorporating a figurative element (figure) and which emits a high luminosity, with the figure formed in high relief with respect to a contrasting background sheet or carrier that supports or incorporates the figurative element, with the fundamental feature that the molded "body" (i.e. the display-carrying component combination of the figure and the carrier) of the device can be formed, alternatively, either as an integral part of the housing of the overall sign, billboard, etc., i.e., as one unitary piece with the housing (the portion of the overall sign, billboard, etc. in which are housed the electrical circuitry, the lighting fixture and usually the controls), or also as a separate piece which may be simply attached to the housing portion of the overall final device.

It is the object of this invention that with this display device, or in other words with the figurative element so formed, it is possible to provide a luminous effect similar to one which could be obtained through the use of the referenced neon tube, but without any of the disadvantages of a neon tube and essentially at a much lower cost and without requiring any maintenance. In contrast to a neon tube, this device has great strength, and, furthermore, its operation is not affected by weather conditions, so that it is possible to install the device outdoors without danger to its integrity, to such an extent that it can withstand many hailstorms without suffering damage, except, of course, those which are especially severe. Further, it may be added that by proper choice of materials the resistance of the figure may be made such that it can withstand many acts of vandalism such as the blow of a blunt object thrown against it.

Another of the objects of this invention is to provide a device that can operate at full capacity providing figures with very high luminosity and ample visual radius operating with light sources of conventional normal voltage as well as low voltage sources.

It is also the object of this invention to provide a device that can produce with a single molded "body" (i.e. display-carrying component) containing the figure, alternatively, a luminous effect of a single color or of a combination of colors, as well as effects of moving light.

It is also a principal and basic object of this invention to provide a mold useful for the formation of such figures for such display devices in which, by the simple action of manual, pneumatic or mechanical pressure exerted by a mold, which may be digitally controlled by a computer, it is possible to reproduce the shape of a given model, with the essential feature that once the desired piece or pieces are molded, it is possible to return the body of the mold to its original condition, that is to say making disappear or in other words "erasing" the shape of the model, so that it is feasible to form another molded product with this same mold, with the same "modus operandi" used before.

It is an essential object of this invention that recovery of the shape of the mold to its original condition can be carried out also through the simple action of pressure over the mold, without the need to dismember, take apart, change or reshape any individual piece of the mold.

Essentially, this invention provides a mold device with which it is possible to form as many mold configurations as one wants, without any limitation.

Therefore, in one principal embodiment, the invention herein is a display device for visually presenting an illuminated figure to a viewer when the device is illuminated from a light source on the opposite side of the device from the view, which comprises a transparent or translucent sheet having first and second opposite sides and formed therein a narrow, high projection extending from the first side of the sheet, the projection forming the shape of the figure; the projection being axially centrally traversed by a groove extending substantially the entire length of the projection, the groove having a depth determined by the wall thickness of the projection, and the groove opening to the second side of the sheet; and opacifying means cooperating with those areas of the second side other than those adjacent the opening of the groove for restricting or preventing the passage of light from the light source through the sheet in the opacified areas relative to the passage of light from the light source through the groove; whereby passage of the light through the groove illuminates the projection depicting the figure, and the depicted figure stands out visually by contrast to the lesser quantity of light passing through the opacified areas of the sheet.

In another principal embodiment, the present invention is display apparatus for visually presenting an illuminated figure which comprises an enclosure housing a source of illumination, the enclosure being generally opaque on all sides but one, the one side comprising an opening in the enclosure; a display device disposed across the opening, the display device comprising a transparent or translucent sheet having first and second opposite sides and formed therein a narrow, high projection extending from the first side of the sheet, the projection forming the shape of the figure; the projection being axially centrally traversed by a groove extending substantially the entire length of the projection, the groove having a depth determined by the wall thickness of the projection, and the groove opening to the second side of the sheet; and opacifying means cooperating with those areas of the second side other than those adjacent the opening of the groove for restricting or preventing the passage of light from the light source through the sheet in the opacified areas relative to the passage of light from the light source through the groove; whereby passage of the light through the groove from the source of light illuminates the projection depicting the figure, and the depicted figure stands out visually by contrast to the lesser quantity of light passing through the opacified areas of the sheet.

In another principal embodiment, the invention herein is a mold for universal molding wherein said mold is comprised of a large number of very thin rods, rigid, straight and of a small, uniform section, extended longitudinally one along side the other, providing a lateral surface, smooth in all its extension, through which they are juxtaposed laterally among themselves in a slidable tight adjustment relation and able to stay locked among themselves by friction against all sliding among them due to pressure in a transverse direction, external to the set of rods, oriented perpendicularly to the same, being this set of rods surrounded by a frame which encompasses the set completely, adjusting them among themselves, and is furnished with means able to regulate this degree of adjustment between a maximum of a total lock against all movement among them and at least a lesser degree of adjustment able to allow this sliding by axial pressure over the same, in conditions which establish their self-retention when this pressure stops.

Other objects and advantages will be evident from the following description.

BRIEF DESCRIPTION OF THE DRAWINGS

For greater understanding and clarity, this device is illustrated in various drawings, which are simply examples of many possible embodiments of the figurative element, carrier sheet, overall device and mold, as follows.

DETAILED DESCRIPTION AND PREFERRED EMBODIMENTS

Figure 5:
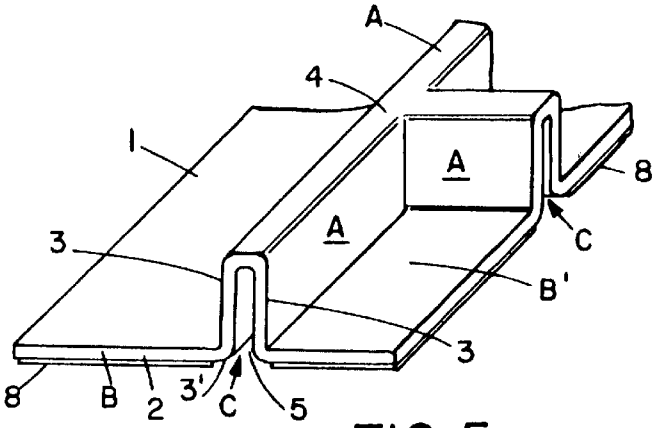
FIG. 5 is an enlarged perspective view of a sector of the said letter "H," showing in detail the projection which defines the figure with respect to the sheet in which it is formed.

The invention herein is best understood by reference to the drawing Figures. Starting with FIGS. 1 through 7, a exemplary display device of the present invention is illustrated in the form of a billboard is shown in which the drawings of a letter "H" and an arrow are inscribed as figures. The lines inscribing these two figures are embodied in the form of a narrow but high projection A provided in a carrier element B, which in this case is made of a sheet of transparent or translucent thermoplastic material, which normally permits the passage of light in all its extension, and in which this projection is formed as an integral part of the same by means of, for example, the technique of thermoforming, and this projection, following the configuration inherent to this drawing, stands out in marked high relief with respect to what may be considered as the external front face 1 of the sheet and, therefore, of the billboard, that is to say the face that will normally be visible to the observer.

This projection A has the fundamental feature that it is traversed, through the back side or internal face 2 of the sheet, by a narrow and deep groove C which, open in this face, extends through the middle of the groove in all its length and is closed at its ends C' (when the projection A has such corresponding ends), thus dividing the groove C in two opposite walls 3 which are connected to each other only at these ends and at the bottom of the same, which corresponds to the crowning 4 of the projection, which results in a transverse section having a "U" shape as can be seen in the Figures.

Figure 6:
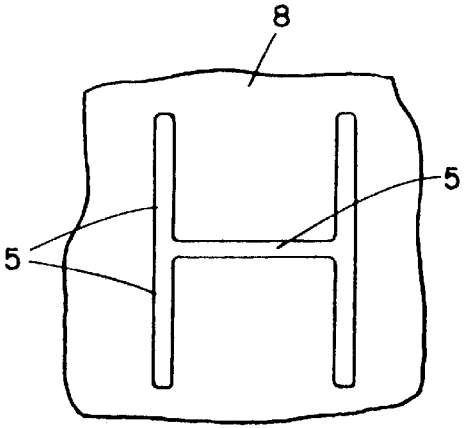
FIG. 6 is a view showing the groove in the back face of the sheet which represents the said letter "H."
Figure 4:
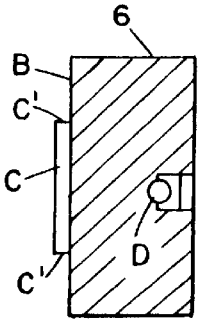
FIGS. 3 and 4 are both cross-sectional views, taken on longitudinal section 3—3 and transverse section 4—4 of FIG. 2 respectively, of the same figures and billboard in which they are contained.
Figure 1:
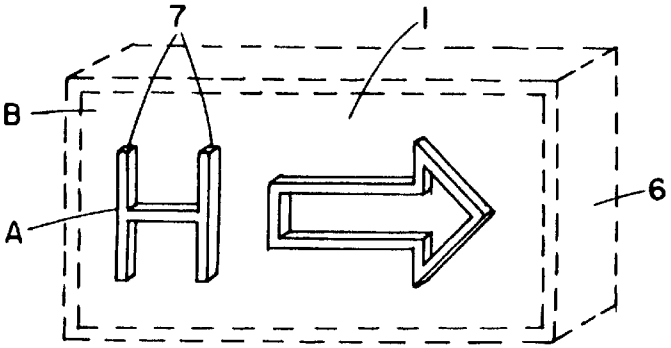
FIG. 1 is a perspective view of a set of two figures consisting of a letter "H" and the drawing of an arrow, both made according to this invention and incorporated into a display device of this invention, illustrated as a billboard.
Figure 2:
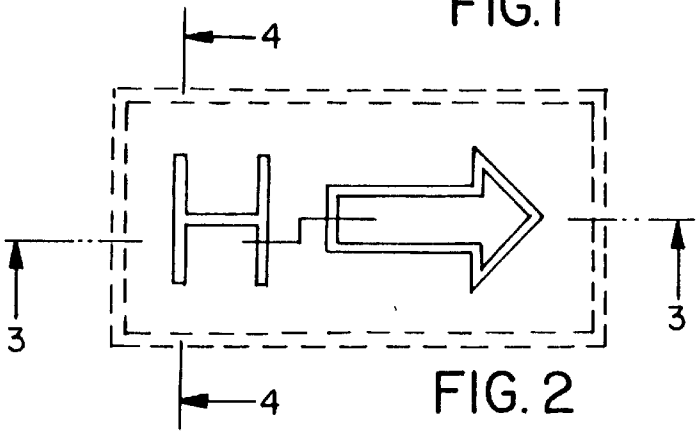
FIG. 2 is a frontal view of the same two figures shown in FIG. 1.
Figure 3:
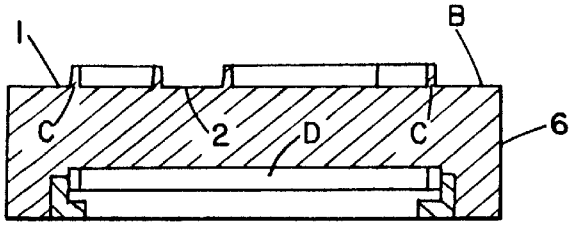

This groove C thus reproduces in the back face 2 of the sheet B the same figure represented by the projection A, but reduced to a slot 5 defined by its exit (see FIG. 6).

Obviously, if the projection A reproduces a closed figure, for example in the case of a circle, triangle, etc., it will not have any ends and its contour will extend without termination, and the same then happens with the groove C, just as in the case of the drawing of the arrow or any other closed figure.

The projection A, according to the figure that it represents, could be made up of sections that intersect (see FIG. 5) or connect to each other, and in this case the groove C reproduces these intersections or connections, just as can be seen in the said FIG. 6.

All of the remainder of the sheet B which surrounds the said projections A is treated so as to intercept the passage of at least most of the light originating from a source situated behind the same, with the exception of the sectors encompassed by the projections in which the light radiation passes into the interior of the groove C through the mentioned slot 5, making this ample sector B' a contrasting background, this condition determined in a manner that is explained later.

This groove C makes thus a chamber for the diffusion of the light to the exterior through the said walls 3, crowning 4, and eventual ends C' of the projection, with the light originating from the said light source D.

In other words, it can be said that the back face of the sheet intercepts the light in all its extension, with the exception of the narrow slot 5 which coincides exactly with the groove C of each projection, including all its length and width which corresponds to the separation that exists between both sides of the same, that is to say between the walls 3 in which it divides the projection.

Preferably the light source D will be enclosed in a box or housing 6 with the sheet B applied as a wall or lid of the same so as to obtain that at least most of the light radiation is focused on the back face of the sheet, directly and/or by reflection on the walls of the box.

As is easy to comprehend, with the device thus made, at least most of the emission of light to the exterior from the interior of the box is produced through the lateral walls 3, crowning 4 and ends 7 (if it has them) of the projection A, which as a consequence is profusely illuminated in all its exterior surface, notably standing out against the contrasting background B' which defines the rest of the sheet that extends around the projection, that is to say the figure that it represents.

This condition of a contrasting background B' is determined in this example by the opaqueness of the remaining part of the sheet, obtained by means of an adequate coating 8 of the internal face 2 of the same, totally opaque; but it also could be determined by a partially translucent coating whose nature permits it to emit a soft luminosity less intense than the brilliant luminosity inherent to the projection, which will allow it to act as a contrasting background.

This soft contrasting luminosity could be obtained by applying a coating on the back face of the sheet which limits to a greater or lesser degree the passage of the light but without intercepting it totally.

This coating 8 could be made of, for example, a coat of paint applied on the back face 2 of the sheet, outlining the mentioned slot or more exactly the mouth of the groove.

Figure 7:
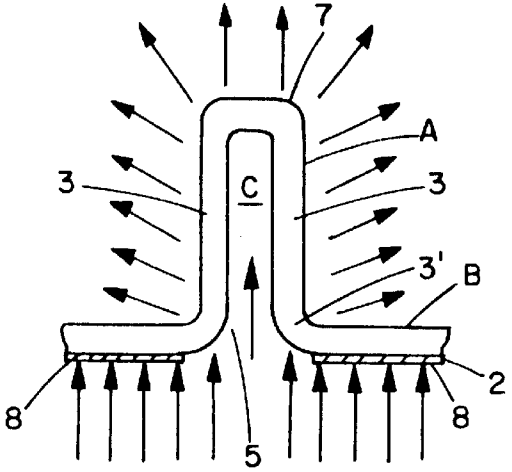
FIG. 7 is a detailed view of the transverse cross-section of the said projection, which forms the figure standing out of the front face of the sheet that constitutes the element that carries the same, showing the behavior of the light which striking on the back face of the sheet is diffused to the outside only through the said projection.
Figure 7A:
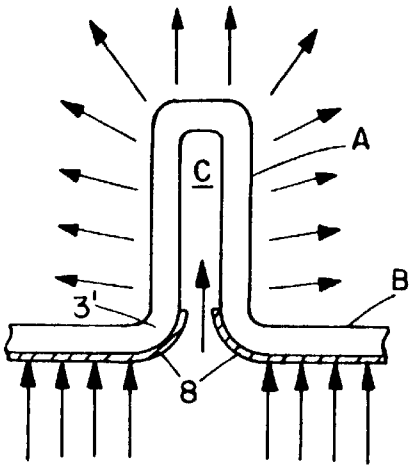
FIGS. 7A and 7B are both views related to FIG. 7 but showing two variants based on the extent of the opaque coating of the back face of the sheet.

In the case that this exit 5 is defined between two convex curved areas 3' of both walls 3 of the projection, which connect these walls with the adjacent part of the sheet, as is shown in FIGS. 5, 7 and 7A (just as happens, for example, when a thermoforming process is used to make the projection), it is contemplated that the said coating 8 leaves both areas completely or in large part uncovered so as to obtain that part of the light radiation which enters in the groove diffuses through these areas to one or the other side of the projection, the adjacent sector of this sheet managing moreover to produce a slight diffusion, creating an interesting luminous effect.

Figure 7B:
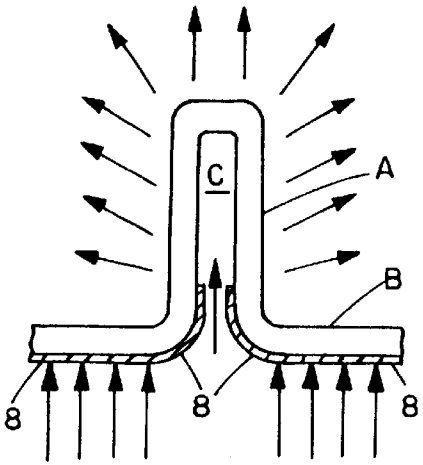

The preceding statement is not a limitation since the said coating 9 could extend inside the groove covering completely the said curved areas 3' (see FIG. 7B) and, moreover, extending farther than these areas, covering part of its sides, so as to concentrate the diffusion of the light through the area of the crowning of the projection, creating another interesting luminous effect which will determine that the symbol seems detached from the carrying sheet B in which it is formed.

Figure 8:
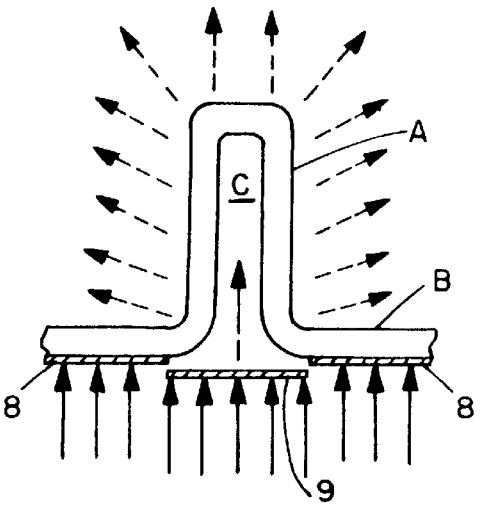
FIG. 8 is a view similar to FIG. 7 but showing how the color of the light is modified through the use of a filter applied to the back face of the sheet.

The color of the light which is emitted through the said projection could be the color inherent to the light source or the color resulting from the application of a filter 9 on the back face of the sheet covering the slot 5 of the groove (see FIG. 8). Filter 9 may be monochromatic or multicolored.

This filter 9 can be made of one piece, of the desired color, applied so that it covers all the slot corresponding to a single symbol or group of symbols, or it could be made of various pieces of different color placed one after the other, along the length of the said slot, so as to obtain a multicolored effect in one single projection, unlike a symbol represented with neon tubes in which it would be necessary to employ various tubes of different colors placed one after the other with the inevitable discontinuity of the "outline" of the symbol.

It is foreseen that an interesting alternative relating to the illumination of the figurative clement can be carried out by means of a moving light source, combined or not with filters that accompany its movement, or by the combination of a stationary light and filters of different colors that move behind the sheet, between the mentioned slot 5 and the light source, so as to create a mobile multicolored effect in the mentioned projection which forms the figure.

A number of different types of plastics can be used for the "body" (i.e., the sheet B with the projections A) but they must all have the properties of suitable moldability, adequate transparency or translucency, strength to hold the molded shape, and compatibility with any opaque coating. Polycarbonate resin is preferred to make the sheet B in which is formed the projection A which incorporates the figure, due to its high transparency, which it obviously provides to the same; its high resistance to the harshest meteorological conditions, rain, hall, snow and the ultraviolet rays of sunlight, which assures the immutability of the symbol, since all die exposed surface of the symbol as well as its contrasting background is defined by the surface of the polycarbonate sheet; and its strength, which enables it to withstand many typical acts of vandalism, such as impact from thrown rocks or other hard objects. In a preferred embodiment, the sheet B and the housing for the rest of the device are both made from the same material. This will be particularly true when the sheet B and the housing are molded together or otherwise integrated into a unitary structure.

Figure 9:
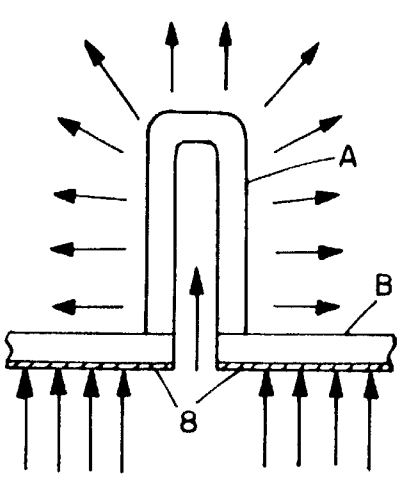
FIG. 9 is a view similar to FIG. 7 but showing a variant in the way of realizing the projection that forms the symbol.

Other embodiments of the projections A are contemplated within the scope of this invention, such as those which are illustrated by example in FIG. 9, according to which the projection A, which makes up each symbol, is formed by a "U" section profile of transparent plastic material which is applied in an inverted position over a carrier sheet or base B of any material, so that it coincides with a slot in the sheet which reproduces the configuration of the symbol.

It is important to note that this slot of the carrying sheet could be defined by a succession of round holes or short slots or cuts made by a boring tool.

The attachment of the molded body prepared in the indicated form to the housing or enclosure of the overall sign, etc., can be carried out by gluing, mechanical attachment, or any other of the forms anticipated by the industry. Alternatively the body can be molded integrally with the molding of the housing, so that the two form a unitary piece.

In a variant of the example shown in FIG. 9, the mentioned profile could have, in relation with the area of the crowning of the projection, a "quasi" tubular form which encompasses an annular sector of more than one hundred eighty degrees, with the goal of obtaining a greater light dispersion surface with a certain tube effect.

As to the manufacture of the display devices and formed figures of this invention, it is foreseen that the vacuum thermoforming process already indicated will be utilized, but this does not eliminate the possibility of adopting any other system anticipated by the industry, for example cast pressure forming, injection molding, etc.

It is preferred to utilize the unique mold device which is also part of the present invention, in that it is uniquely capable of forming the intricate shapes of the projections A in a rapid, simple and repeatable manner. As exhibited and illustrated in FIGS. 10 through 22, the basic characteristic of the unique mold is centralized in the fact that the body of the mold is comprised of a large number of very thin rods 20, rigid, straight and of a uniform section in all their length, round in this example, of a very reduced diameter, about 1.5 mm or a bit more, and of the same length, which as will be seen later depends on the depth of the concavity or the height of the projection which one wishes to form with the mold, and on the other hand all of them offer a lateral surface 30 which is extremely smooth through its length, so that they can slide among themselves.

These rods 20 are assembled by lateral juxtaposition among themselves in a slidable tight adjustment relation extending in width and length according to the size of the different molds that one Is interested in making in this same body based on the novel, inventive concept here proposed.

This tight adjustment among the rods is provided by a peripheral frame 21 that completely surrounds the set of rods, exerting a pressure in the transverse direction, oriented perpendicularly to the rods, which are encompassed in at least most of their length, so as to establish a perfect adjustment among themselves, to accomplish which this frame has an internal face 19 which contacts those rods located on the periphery of the set of rods determined by a straight generatrix parallel to them.

This frame 21 determines thus that each rod 20 remains firmly and equally pressed among all those which surround it.

This frame 21 has, in this case, a rectangular configuration and offers controllable means 23 of adjustment around the set of rods which it frames, defined, by way of example, for the arrangement of elements which is shown in the drawings.

It must be noted that the configuration of this frame and the space which it encompasses can be changed correspondingly with the size and shape of the successive molds that one wishes to execute in the same body of rods which it surrounds.

It must also be noted that here a mold body proportionally ample and of regular height or thickness has been obtained, in which the mass of rods offers flat surfaces 22 and 24, each defined by the equally flat end 13 of the same.

The four sides of this frame 21 are substantially rigid and three of them 14 and 15 are rigidly joined among themselves by two of their vertices 16, while the fourth side 17 is applied so that it can be moved between the ends 15' of the two adjacent sides 15 moving closer to or farther away in relation to the opposite side 14, like a piston, so that it is possible to change in a restricted manner the size of the frame 21, making it greater or lesser, and thus change, consequently, the degree of adjustment among the rods 20, between a maximum which determines a total lock against all longitudinal sliding among themselves and in relation to the frame, and at least a lesser degree of adjustment, but adjustment nonetheless, able to allow a controlled sliding by axial pressure over the same, in conditions which allow its self-retention by friction to be obtained when this pressure stops and to reestablish consecutively a maximum degree of adjustment which locks the rods against all sliding among themselves, even when pressure is exerted over the surfaces which they define by their ends, for example the surface on which the molding operation will be carried out.

The said movement of the piston side 17 is controlled by the said regulable adjustment elements 23 comprised in this case of both screws 18 which link the ends 17' of this fourth side with the ends 15' of the said adjacent sides, placed in accordance with the illustrated arrangement in such a way that when they are unscrewed the said side withdraws loosening the rods 20 and with that a lesser degree of adjustment is obtained which permits the sliding among them, and conversely as they are screwed in the rods are compressed determining the maximum degree of adjustment which immobilizes the rods among themselves and with respect to the frame.

Obviously, when one talks about the movement of said piston side 17 of the frame, it must be understood that one is dealing with only a small millimetric fractions.

In review, the adjustment among the rods is regulated, as greater or lesser, by means of the mentioned screws 18 of the frame 21.

It is clearly stated that no limitation of any kind is established with regard to the realization of the regulable adjustment elements 23 of the frame, the utilization of any other arrangement being contemplated based on, for example, the use of hydraulic or pneumatic cylinders which act over one or more sectors of the frame, electromagnetic means, a worm screw mechanism, etc. and/or combinations of the same, etc.

Neither is any limitation established with regard to the shape and realization of the frame.

It must be reiterated that the essential concept of the invention is that the adaptable body of the mold is composed of a bundle of rods laterally juxtaposed among themselves and that this bundle is "tied" by an adjustable frame which wraps around the same and which can be regulated so as to, on the one hand, immobilize all sliding among the rods and, on the other hand, allow a controlled sliding of the rods under pressure.

It is foreseen within the scope of this invention to apply the body of the mold thus assembled in relation with a base or backing plate 35 which offers a flat surface 27 over which the set of rods 20 will sit, with the fastener of the frame adjusted so that among the rods exists the mentioned minor degree of adjustment and, thus, it is possible to level the whole mass of rods pressing them against this plate from the end opposite to that which faces the plate.

In this manner the body of the mold becomes ready in condition to reproduce the desired shape in the body.

The rods may be made of metal, ceramic, hard plastic or other material of suitable strength and resistance to abrasion when the rods slide relative to each other. Similarly the mold frame may be made of metal, wood, ceramic, hard plastic or other suitable material which has sufficient strength and heat resistance to maintain its shape under molding conditions.

Figure 13:
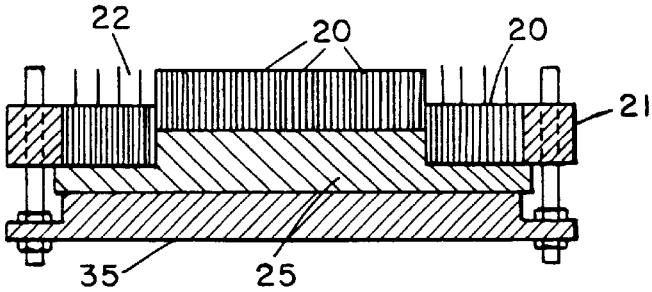
FIG. 13 is a view similar to FIG. 12, showing one of the ways to obtain the shape of the mold, applying with pressure the body of the mold over a model that reproduces this shape.
Figure 14:
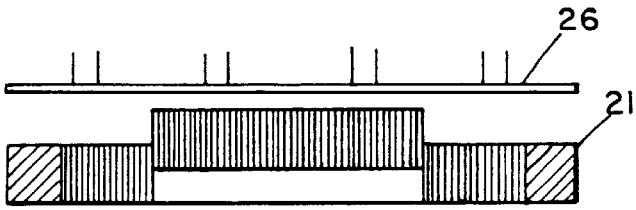
FIGS. 14 and 15 are schematic cross-sectional views of the molding operation procedure illustrated in FIG. 13, illustrating respectively the situation before and after the molding of a sheet.

In the example illustrated by FIG. 13, incorporated between the plate 35 and the face 24 of the set of rods facing the same is a model 25 which represents an figure (e.g., an arrow) that one wants to reproduce on the opposite face 22, and pressing over the face 22 causes the sliding of the rods 20, so that they slide among themselves, resting on the surface of the model 25 by the ends 13 which face it and, thus, is obtained the reproduction of the model by the opposite end of all the mass of rods, in the other face 22 of the set of rods, as can be seen in FIG. 14.

Figure 16:
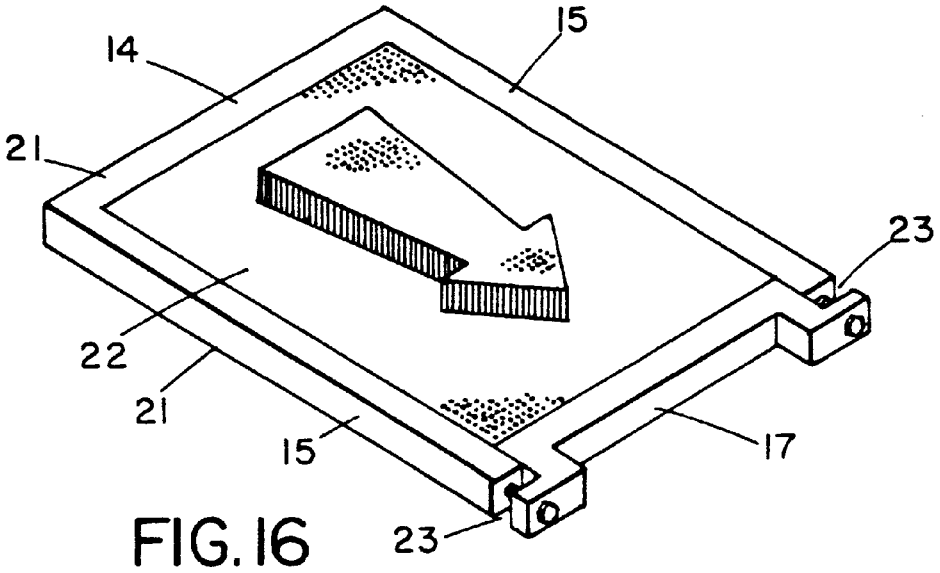
FIG. 16 is a perspective view similar to FIG. 10, showing the shape of the male mold illustrated in FIG. 16
Figure 11A:
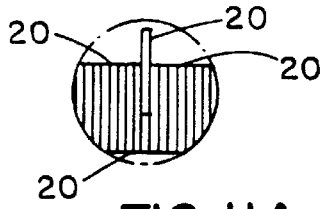
FIG. 11 is a transverse cross-sectional view of the same body of FIG. 10, with an annex detail view where a sector of the same is shown in larger scale.
Figure 11:
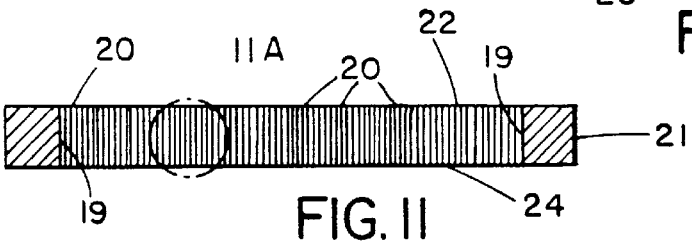
Figure 12:
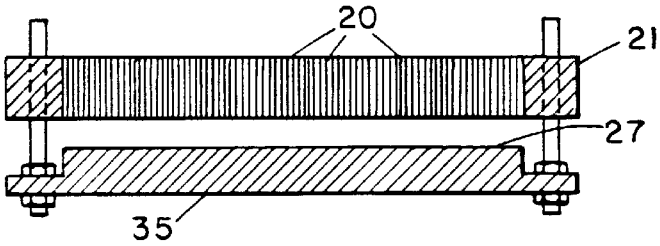
FIG. 12 is a view similar to FIG. 11, showing the body of the mold with a plate to level the position of the rods of which the body is composed.
Figure 15:
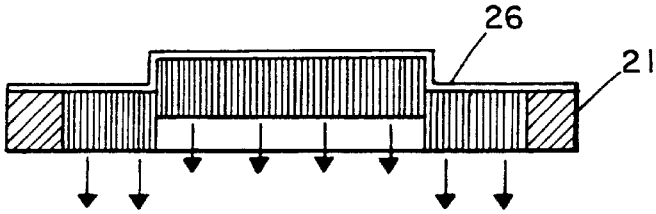
Figure 21:
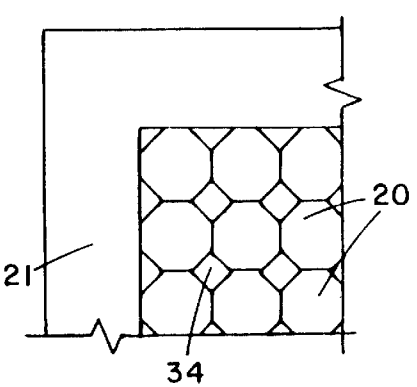
FIG. 21 is also a view similar to FIGS. 17, 19 and 20, showing the arrangement of the rods with an octagonal section.

After this process, it is only necessary to readjust the fastener of the frame by tightening in the screws 18 and, thus, one can remove the mold, which remains formed as is illustrated in FIGS. 14, 15 and 16, and which can be used with the molding technique most appropriate for the proposed objectives.

Figure 10A:
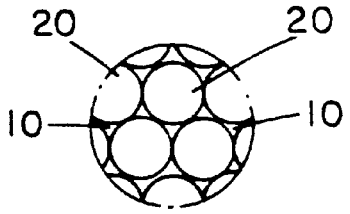
FIG. 10 is a perspective view of the body of a mold of this invention with two annex detail views that illustrate in detail two aspects of the arrangement of its component elements.
Figure 10B:
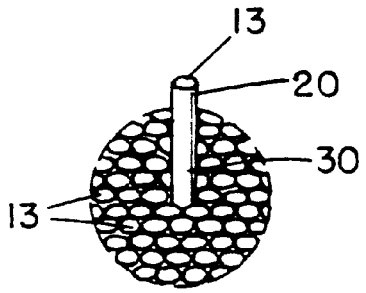
Figure 10:
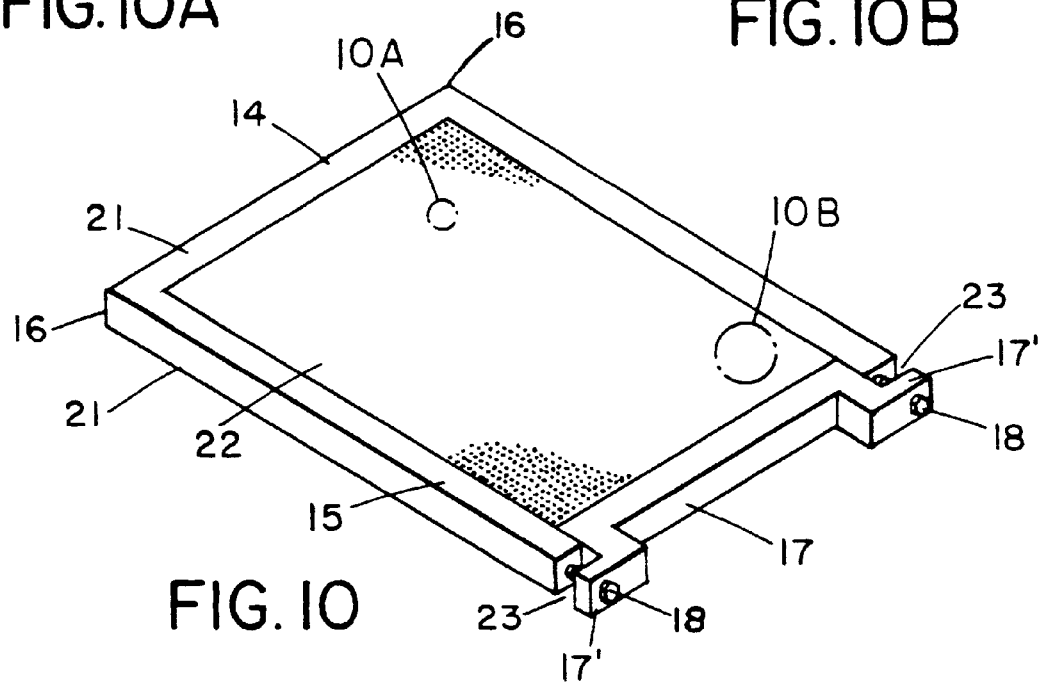

The mold thus formed is particularly applicable for the technique of vacuum thermoforming because, thanks to its ingenious realization, there are obtained, due to the simple fact that it is composed of cylindrical rods 20, juxtaposed closely among themselves, a large number of conduits 10 which run through the mold from one side to the other, with each one delimited between three adjacent rods (see the detail extensions of FIG. 10).

In accordance with this technique, the sheet of plastic material 26, heated to the necessary temperature, is placed over the face 22 of the mold which one wishes to reproduce and the vacuum is created through the said conduits 10, that is to say between the rods 20, from the opposite face 24, achieving, thanks to this large number of passages, a close juxtaposition of the sheet to the said surface and consequently the reproduction of its shape (FIG. 15).

With the body of the mold thus formed, once the piece or the quantity of required pieces has been molded, it is only necessary to place it on the mentioned base plate 35, slightly open the frame by loosening the screws 18, so that the mentioned lesser degree of adjustment is established among the rods, and then apply pressure over the face 22 of the set of rods so that all the rods slide among themselves and come to rest by the end of their face 24 on the plate 35, returning thus to a level surface. in conditions to readjust the lock fastening the rods, and allow, for example, the set of rods to be applied over another model.

Thus, the basic objective of this aspect of the invention is achieved, to the effect that in a single mold body it is possible to form as many molds as one wishes.

Instead of the process described, the positioning of the rods with respect to their height within the frame can be done manually, or by mechanical means and combined with a computer and a digitally controlled machine, with coordinate axes, whose tool drives the rods, changing their height with respect to the surface of the fastening frame.

In this manner, the operator draws on the computer screen the desired shape of the mold, and the machine through its tool positions the rods automatically.

For certain molding situations (pressure molding) where it is necessary, for design reasons, to utilize two molds (a male and a female), two molds for universal molding, made according to this invention, can be used in the thermoforming machine.

Figure 17:
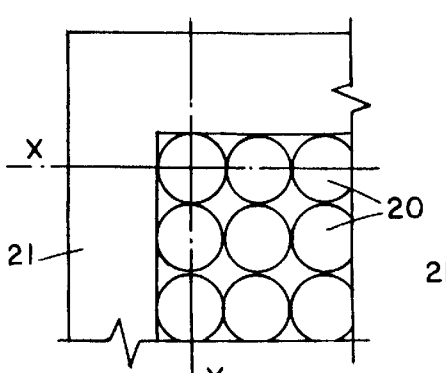
FIG. 17 is a partial view of one sector of the set of rods and frame in accordance with another arrangement of the same, in two rows perpendicular to each other, according to two coordinate axes.

It is foreseen within the scope of this invention to arrange the rods a according to two coordinate axes, that is to say forming parallel rows in two perpendicular directions "x" and "y", so that every four of them adjacent to each other are arranged according to the vertices of a square, as it is illustrated in the sketch in FIG. 17.

To ensure that the rods 20 stay in this arrangement when the body of the mold is assembled within the frame, and when the adjustment between the rods is lessened, to permit the required sliding so that they adapt to the model one wishes to reproduce, the use of a plate 28 is contemplated for assembly and retention of the rods in the said position, made by a laminate piece which extends affixed to one of the faces of the set of rods, for example the lower one (FIG. 18), each one of them has a thin spike 20' coaxial to the same, which having a somewhat smaller diameter, for example 1 mm with respect to the 1.5 mm of the rod, is inserted in an orifice 10 of this plate, which has in turn a diameter slighter bigger which determines a loose adjustment between the spike and the border, enough to allow the slight lateral play among the rods in the said two dimensions perpendicular to each other, required in one direction to loosen them allowing a controlled sliding which permits their positioning according to the shape of the mold, and in the other direction to establish a tight adjustment that blocks all movement among them.

Figure 18:
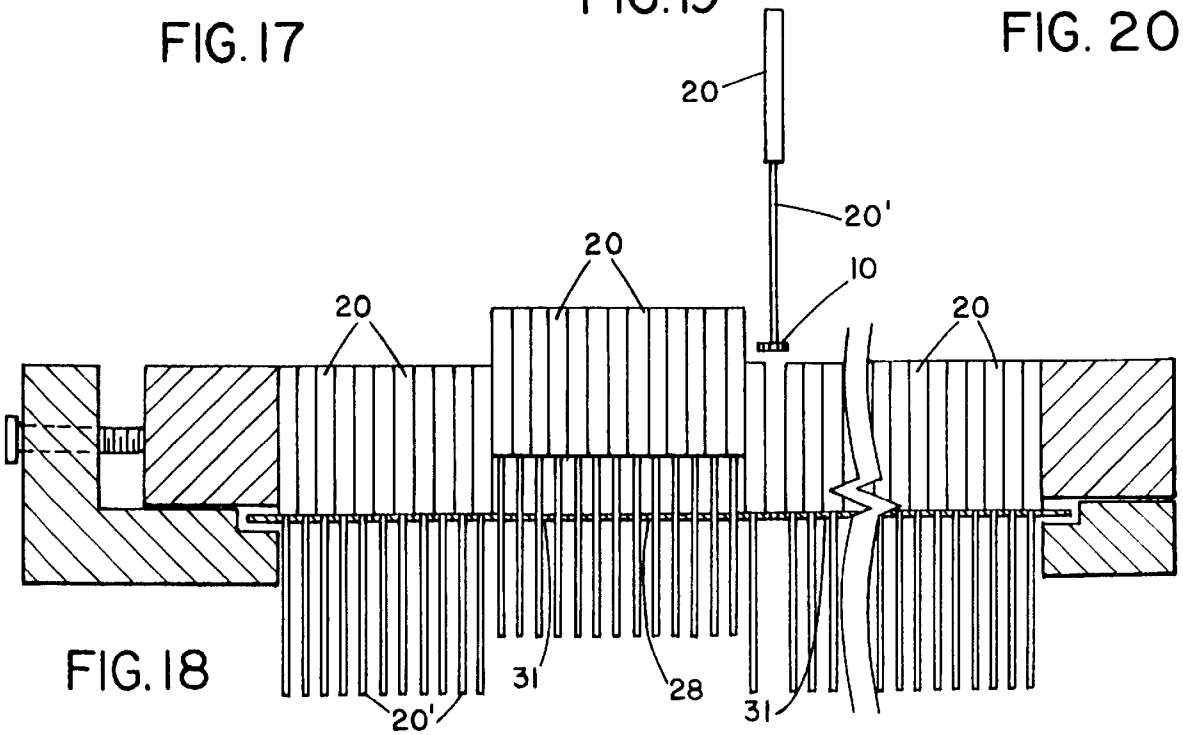
FIG. 18 is a longitudinal cross-section view of the same set of rods and frame, showing the rods placed in a retention plate.

This plate can be applied to the frame, as is illustrated in FIG. 18, fastened so that it does not obstruct the cited slight movement of the rods under the effect of the tightening of the mentioned side of the frame.

This plate is very thin so its thickness does not limit the stroke of the piston which, as is foreseen, can act against the rods to position them by means of a device operated by a computer.

It is foreseen to reinforce this plate by means of thin ribs 31 extending among the said spikes 20'.

Figure 20:
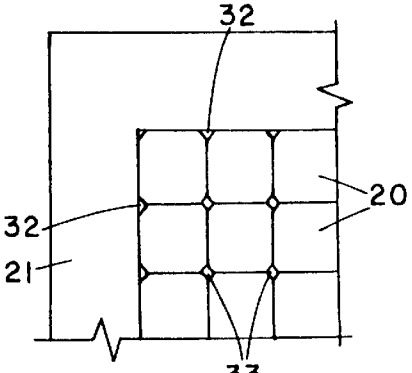
FIG. 20 is a view similar to FIG. 19, showing a variation of the section of the rods with a prismatic shape.
Figure 19:
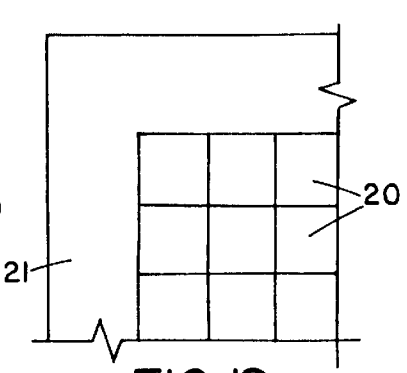
FIG. 19 is a view similar to FIG. 17, showing the rods in accordance with a quadrangular section of the same.

It must be noted that in this case the rods could be of a square section, instead of circular, juxtaposed laterally among themselves face to face (see FIGS. 19 and 20).

The corner edges 32 could be rounded or cut by narrow notches so as to form narrow conduits 33 equivalent to the conduits 10 of the first example, required to allow the vacuum action in the process of molding by thermoforming.

In addition, the rods could be of a regular octagonal section (see FIG. 21) juxtaposed laterally among themselves by their faces coinciding with the two directions in which they are oriented; in this manner between the other four faces (of each group of four rods), which have spaces among them, conduits 34 will remain equivalent to the mentioned conduits 10.

Figure 22:
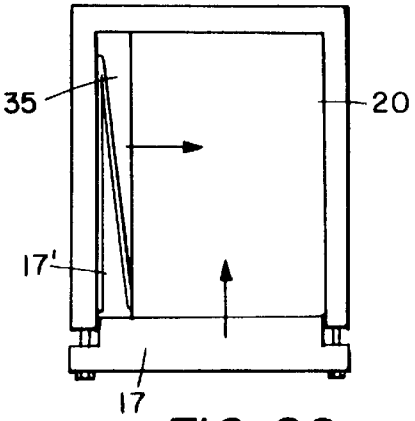
FIG. 22 is a schematic top view of the set of rods and frame, showing a variation in the way to fasten the rods, applicable preferably for the arrangement and sections illustrated in the FIGS. 17, 19, 20 and 21.

The experiences realized have established that the rods of these examples will be adequately tightened in the case of applying pressure in one direction by means of the same side which acts as a pressing piston in the frame of FIG. 10, or in both directions by means of a variation of this frame as is illustrated in FIG. 22, in which the said piston side has a projection in the form of a sharp wedge 17' which is inserted between one of the fixed sides of the frame and an auxiliary piston side 35 which on its internal side tightens against the rods and on the opposite side provides an oblique face over which said projection is wedged obtaining in such a way the desired double pressure.

It will be evident that there are numerous embodiments of the present invention which, while not expressly described above, are clearly within the scope and spirit of the invention. The above description is therefore to be considered exemplary only, and the scope of the invention is to be limited solely by the appended claims.

I claim:

1. A display device for visually presenting an illuminated figure to a viewer, when said device is illuminated from a light source on the opposite side of said device from said view, which comprises:

at least a light transmissive sheet having first and second opposite sides and formed therein a narrow, high projection whose height substantially exceeds its width which extends from said first side of said sheet, said projection forming the shape of said figure;

said projection being axially centrally traversed by a corresponding narrow and deep groove extending substantially the entire length of said projection and opening to said second side of said sheet; and opacifying means cooperating with those areas of said second side other than those adjacent said opening of said groove for at least restricting the passage of light from said light source through said sheet in said opacified areas relative to the passage of light from said light source through said groove; and color imparting means for imparting multiple colors to the visual appearance of said projection forming said shape of said figure;

whereby passage of said light through said groove illuminates and imparts said multiple colors to said projection depicting said figure, and said depicted figure stands out visually by contrast to the lesser quantity and different color of light passing through said opacified areas of said sheet.

2. A display device as in claim 1 wherein said color imparting means comprises colorants incorporated into said sheet.

3. A display device as in claim 1 further comprising at least a light transmissive filter sheet placed across at least a portion of said opening of said groove between said groove and said light source, said filter sheet being multiple colored, whereby said colors of said filter sheet are transmitted through said groove by said light and said multiple colors are thereby imparted to said projection.

4. A display device as in claim 3 wherein said filter sheet is adhered to said second side bridging at least a portion of said opening of said groove.

* * * * *